US005391010A

United States Patent [19]

Gorbunov

[11] Patent Number: 5,391,010

[45] Date of Patent: Feb. 21, 1995

[54] WRITING DEVICE

[76] Inventor: Alexci E. Gorbunov, ul. Gamalei d.10,kv.24, Moscow 123098, Russian Federation

[21] Appl. No.: 87,779

[22] PCT Filed: Sep. 21, 1992

[86] PCT No.: PCT/RU92/00175

§ 371 Date: Jul. 7, 1993

§ 102(e) Date: Jul. 7, 1993

[87] PCT Pub. No.: WO93/13949

PCT Pub. Date: Jul. 22, 1993

[30] Foreign Application Priority Data

Jan. 13, 1992 [RU] Russian Federation ..... 5022490/12

[51] Int. Cl.[6] ..... B43K 23/00; B43K 25/00

[52] U.S. Cl. ..... 401/8; 401/7; 15/443

[58] Field of Search ..... 401/7, 8; 15/443

[56] References Cited

U.S. PATENT DOCUMENTS

| | | | |
|---|---|---|---|
| 147,930 | 2/1874 | Galland | 15/443 |
| 365,810 | 7/1887 | Harris | 401/8 X |
| 657,370 | 9/1900 | Ward | 15/443 |
| 967,410 | 8/1910 | Montgomery | 401/8 |
| 1,652,072 | 12/1927 | Vanek | 401/8 X |
| 2,509,837 | 5/1950 | Niizawa . | |
| 2,826,175 | 3/1958 | O'Connell . | |
| 4,037,975 | 7/1977 | Huffman . | |
| 4,127,338 | 11/1978 | Laybourne . | |
| 4,689,020 | 8/1987 | Rusk . | |

FOREIGN PATENT DOCUMENTS

| | | | |
|---|---|---|---|
| 295126 | 10/1991 | German Dem. Rep. | 401/6 |
| 3801333 | 8/1988 | Germany . | |
| 3805997 | 9/1988 | Germany . | |
| 394 | of 1865 | United Kingdom | 15/443 |
| 19417 | of 1906 | United Kingdom | 401/8 |
| 1253519 | 11/1971 | United Kingdom . | |

*Primary Examiner*—Steven A. Bratlie
*Attorney, Agent, or Firm*—Collard & Roe

[57] ABSTRACT

A writing device capable of increasing the rate of writing, and reducing fatigue in case of prolonged writing. The device facilitates the handwriting process for sufferers from arthritis, invalid persons deprived of some fingers, students, computer users, pressman, and children. The device includes a ring that is an extension to a body and is made integral therewith. The hole of the ring is elliptical in shape, and the body line interconnecting the tip of a writing element and the nearest point on the ellipse intersects the major axis thereof at that point. A complete elimination of static tensioning of the fingers holding the pen is attained. A counterweight located on the ring on the side opposite to the writing element is provided to maintain the center of gravity at the point of support of the device.

6 Claims, 4 Drawing Sheets

WRITING DEVICE

TECHNICAL FIELD

The present invention relates to writing devices that reduces writer's fatigue due to prolonged work, as well as allowing persons suffering from hypokinesia of the fingers or having some of the fingers amputated or absent congenitally, and also preschool children to master the writing skill.

BACKGROUND ART

There are many writing devices in common use nowadays, which consist usually of a body shaped as a hollow cylindrical rod into which a writing element (such as a ball-point rod, pen, pencil lead, etc.) is fitted. However, after prolonged work with such devices the writer's hand becomes fatigued, this phenomenon being explained as follows. The point of support is situated in said devices at the place of grasping the body with the three writer's fingers. Efforts applied by the fingers during writing with such devices are composed of a body grasping force (the static one) and a force for displacing the body end (the dynamic one). At present a number of the writing devices have been developed allowing of partially reducing the static force applied during writing. Nevertheless, there exists a great contingent of humans for whom a necessity of grasping the writing device during writing is an urgent problem. Belonging to such persons are arthritis patients, those with hypokinesia of the fingers or with partially absent fingers. In addition, the necessity of grasping the pen during writing presents some difficulties in children who start mastering the skill of writing in their early childhood.

Known in the present state of the art is a writing device capable of facilitating the handwriting process, comprising a body carrying a writing element at one of its end and a shaped rest fitted on a threaded rod, at the opposite end thereof, said shaped rest following the shape of the palm at the base of the forefinger (cf. U.S. Pat. No. 2,826,175, Int. Cl. B 43 K 23/00, Nat. Cl. 401-6, 1958). The device is capable of a reduced static load on the fingers due to its thrusting against the palm so that the force pressing the writing element against the paper is relayed to the palm rather than to the fingers. In addition, the construction of the device helps the writer displace the device by the entire hand rather than by the fingers only, thus reducing the fatigue of the fingers and developing a good legible handwriting.

However, using said device the writer's fingers experience a static load due to the necessity of pressing the body of the writing device against the palm. Thus, the fingers remain tensioned even at those instants when they could be relaxed for rest between the letters and words being written.

Another writing device (taken as the prototype) is presently known to comprise a body, a ring to held the body on the writer's finger, and a writing element. A sleeve is fixed in position on the ring which is fitted onto the body (cf. German Patent 3,801,333, Int. Cl. B 43 K 23/00, 1988). The construction discussed above reduces static load on the writer's fingers, as the ring retains the body in the hand without any additional efforts on the part of the writer.

However, the fingers experience static load while pressing the writing element against the paper, whereas the ring cannot take thrust load since it is movable along the body on the sleeve. An additional permanent load on the fingers is due to the fact that the ring construction does not preclude rotation of the body of the writing device round the writer's finger. All this lays obstacles to practical use of the device by the aforementioned human contingent.

DISCLOSURE OF THE INVENTION

The present invention has for its principal object to provide such a writing device that is capable of eliminating static stress of the fingers during writing, thereby facilitating considerably the handwriting process for advanced-age persons suffering from arthritis or hypokinesia of the fingers, those partially deprived of the fingers, as well as for children mastering writing in their early childhood. The present device has to serve for prevention of occupational diseases of the hand in individuals whose occupation involves the necessity for rapid and prolonged writing, e.g., in students, pressmen, computer users, shorthand-typists, etc.

The foregoing problem is accomplished by the writing device of the present invention comprising a body, a ring for holding the body on the writer's hand, and a writing element. The ring is in fact an extension to the body and is made integral therewith, the hole of the ring is elliptical in shape. A straight line interconnecting the tip of the writing element and the nearest point on the ellipse, intersects the major axis thereof at that point. Such a construction arrangement enables one to transfer the point of support in writing to the joint of the forefinger phalange with the wrist of the hand on the palmar side, thereby providing static load relief of the fingers. The point to which the support is transferred is situated at the point of intersection of the straight line interconnecting the tip of the writing element and the nearest point on the ellipse with the major axis of the ellipse. This makes it possible to increase the stability of the device while writing and to eliminate static force exerted on the fingers holding the device.

The present writing device may incorporate a counterweight fitted on the ring on the side opposite to the writing element. The counterweight may be shaped as a projection located on the ring. The projection may be arranged at an angle to the plane of the ring. Provision of said counterweight in the device enables one to coincide the point of support with the center of gravity. In such a case a maximum stability of the device is attained, as well as a minimum effort for displacing the device while writing. The body may have a knurled area and/or recess to receive the holding fingers. The device may also have a loop located at the body end nearest to the writing element. The loop is aimed at fixing the finger end onto which the device is fitted. Such a construction arrangement enables one to use the device with a single finger only. Both the body and the ring may be made of materials differing in elasticity.

EMBODIMENTS OF THE INVENTION

Figure 1:
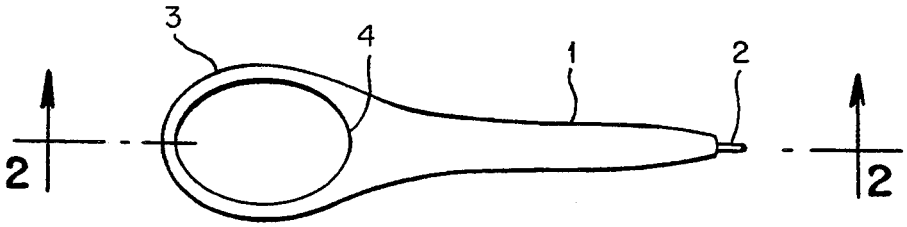
FIG. 1 is a plan view of a writing device.
Figure 2:
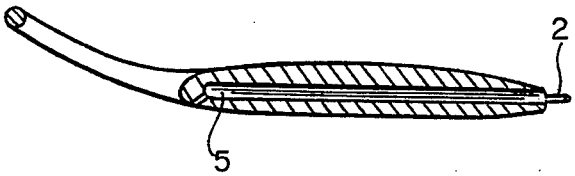
FIG. 2 is a section taken along a line 1—1 in FIG. 1.
Figure 3:
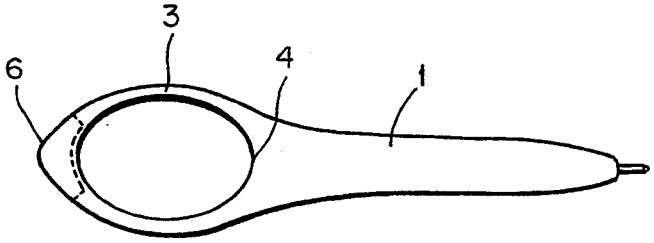
FIG. 3 is an alternative embodiment of the writing device provided with a counterweight.
Figure 4:
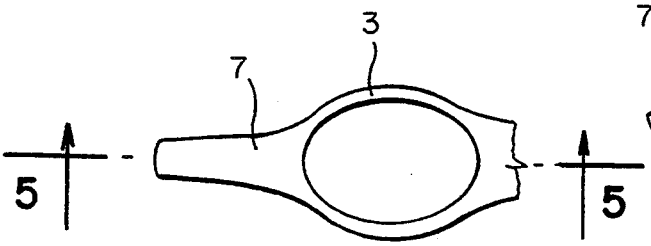
FIG. 4 is an alternative embodiment of the counterweight shaped as a projection.
Figure 5:
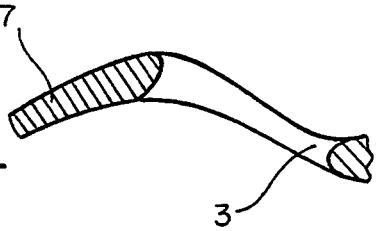
FIG. 5 is a section taken along a line 11—11 in FIG. 4.
Figure 6:
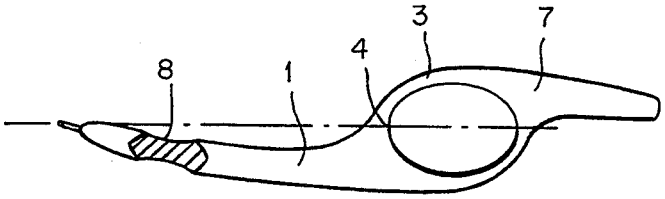
FIG. 6 is an alternative embodiment of the writing device provided a curved body.
Figure 7:
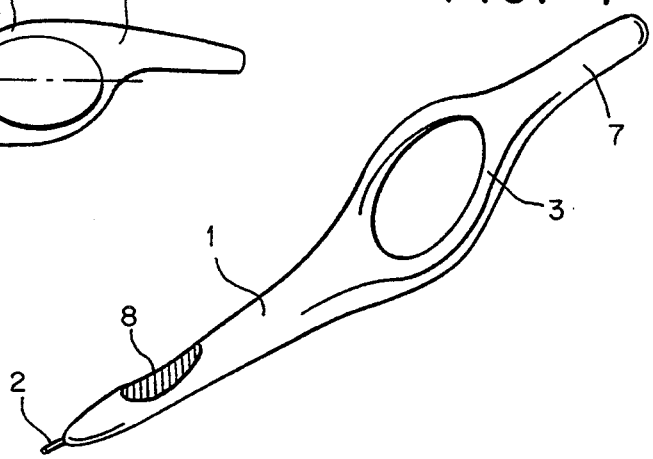
FIGS. 7, 8 depict general views of optimum embodiments of the present writing device.
Figure 8:
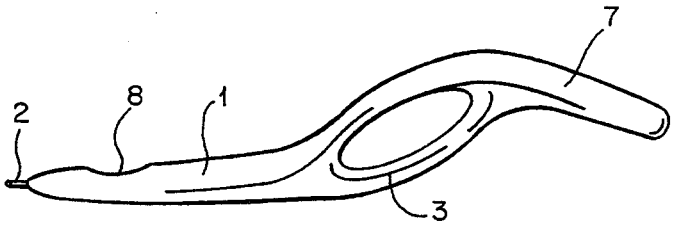
Figure 9:
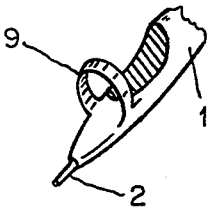
FIG. 9 is an alternative embodiment of the writing device provided with a loop for fixing the finger end.

The writing device comprises a body 1 having a writing element 2 at one of its ends and carrying a ring 3 at the opposite end, said ring being made integral with the body 1. The hole of the ring is elliptical in shape. The straight line interconnecting the tip of the writing element 2 and the nearest point on the ellipsis 4, intersects the major axis of the ellipsis at that point at an angle which is most expedient to be within 28–35 degrees when the device is held by the user's hand most convenient (FIGS. 1, 2). The writing element 2 is located in a groove 5 made in the body 1 (FIG. 2). The writing device may have a counterweight 6 fitted on the ring 3 and appearing as, e.g., a thickening on its side opposite to the writing element 2 (FIG. 3). The counterweight 6 may also be made as projection 7 joined to the ring 3 (FIG. 4). The projection 7 may be arranged at an angle to the plane of the ring 3 (FIG. 5). The body 1 may be curved (FIG. 6). The body 1 may have recesses 8 and/or a knurled area for the worker's fingers (FIG. 7). The writing device may have a loop 9 aimed at fixing the finger end (FIG. 9). The body 1 and the ring 3 may be made of materials differing in elasticity, e.g., material of the ring may be more elastic than the material of the body.

Figure 10:
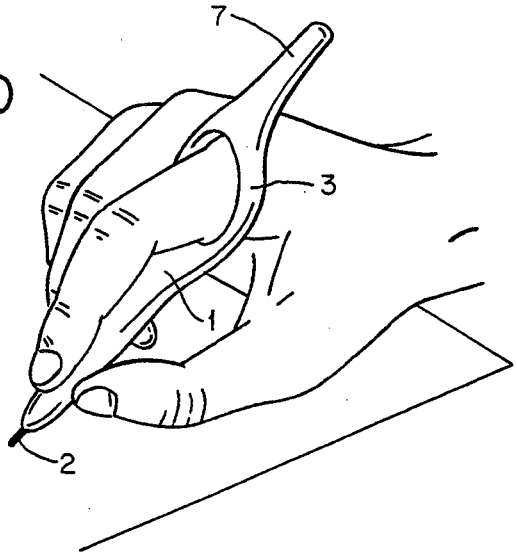
FIG. 10 shows how an optimum variant of the device is held while writing.
Figure 11:
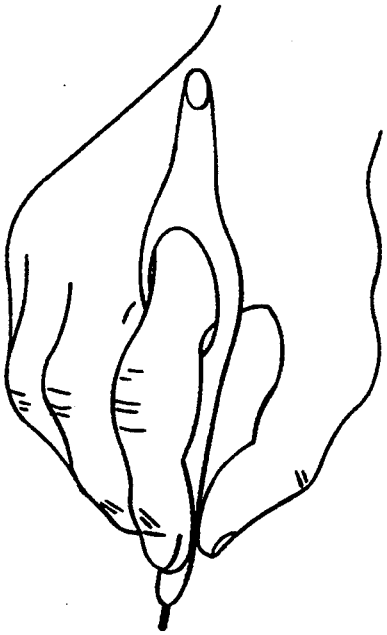
FIG. 11 shows how the device is used by an arthritis patient.
Figure 12:
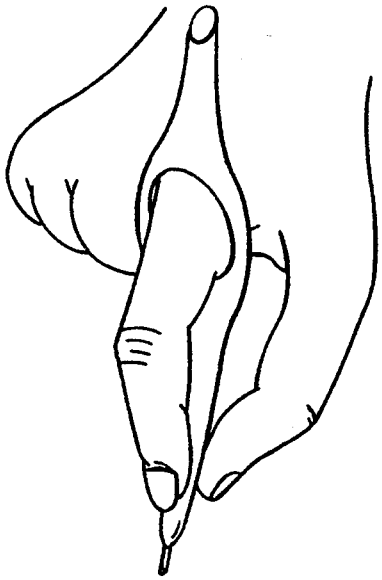
FIGS. 12–16 shows how the device is used by disabled individuals deprived of some fingers or suffering from their hypokinesia.
Figure 13:
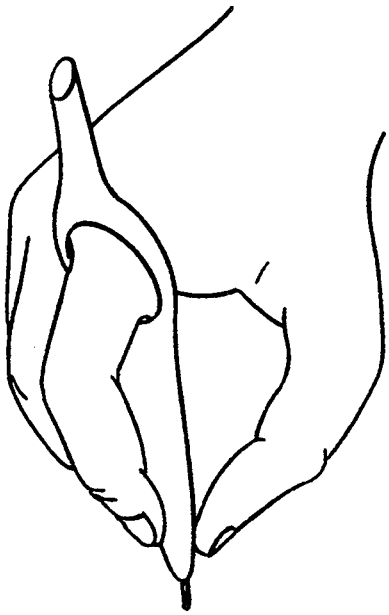
Figure 14:
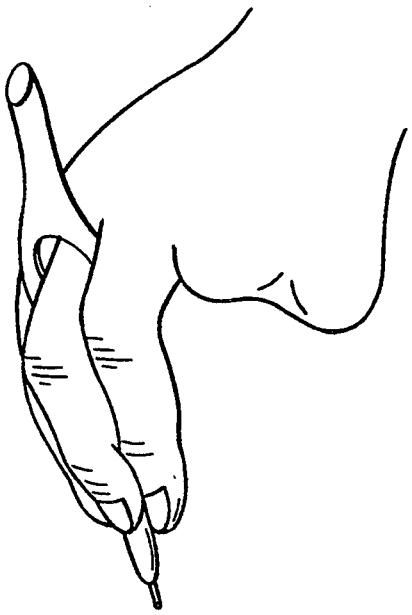
Figure 15:
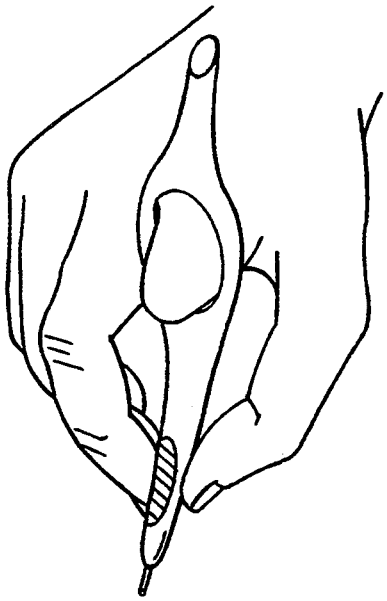
Figure 16:
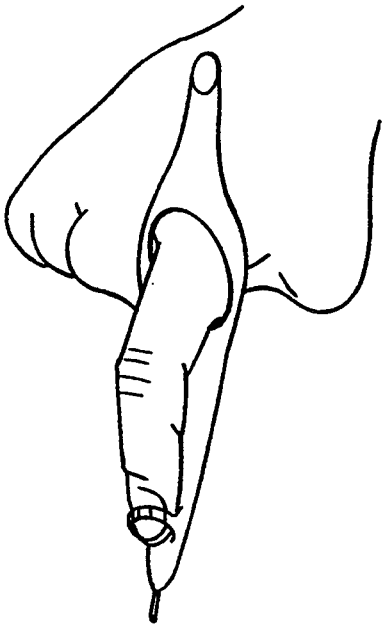
Figure 17:
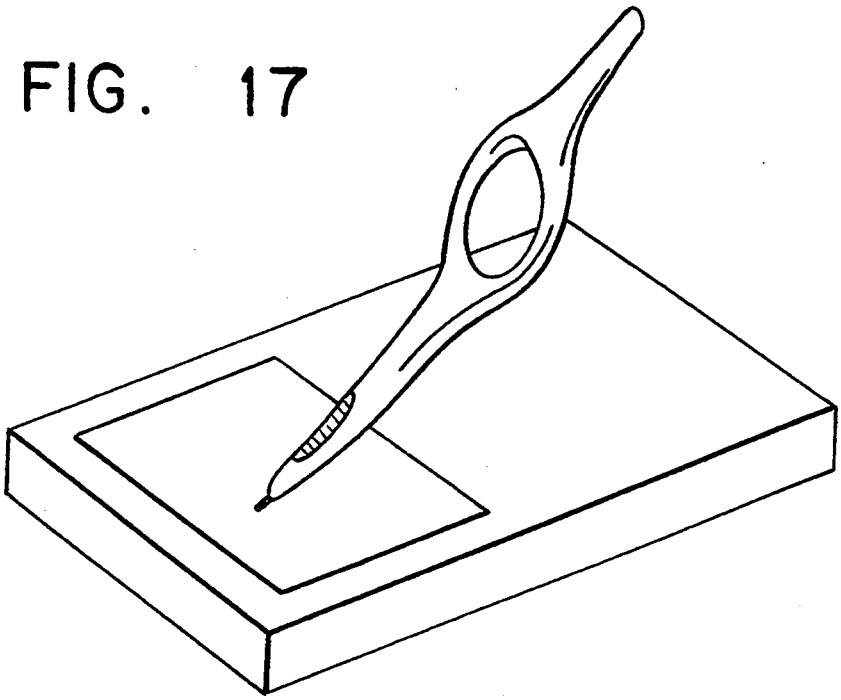
FIG. 17 illustrates an alternative embodiment of the device for writing on the screen of a computer monitor, or for pressing on a surface substituting the computer keyboard.

The writing functions as follows. The user puts his index finger in the ring 3 so that the point of support be at the joint between said finger and the palm, while the finger holds the body 1 from above and the thumb and the middle finger are arranged on the side body surfaces with grasping the body (FIG. 10). The efforts exerted by the fingers are aimed only at displacing the body end while writing so that to grasp the body 1 with the fingers which is the case with a conventional pen or pencil is no longer necessary. High stability of the device during writing is attained due to the fact that the point of support is brought in coincidence with the center of gravity when a counterweight is sued. The point is indicated at Ref. No. 4 in FIGS. 1, 2, 3 and 6. High stability and no necessity for grasping the body with the fingers holding it enable the present device to be used by individuals suffering from arthritis (FIG. 11) and by disabled persons deprived of some fingers (FIGS. 12–16). The device can be held both in the right and left hands. Whenever the user retains only a single finger the loop 9 should be fitted on the present writing device so as to fix the finger end (FIG. 16).

The present writing device makes it possible to avoid the writers' cramp during prolonged writing. This is attainable due to the fact that while writing the fingers holding the device do not grasp the body 1, and the finger muscles are relaxed after each exertion. This feature differs writing with the present device from that with a conventional writing device, such as a pencil or a traditional ball-point pen where the finger muscles are consistently held in a tensioned position. Thus, the writers' cramp occurs due to the fact that the muscles never relax completely during writing.

Thus, use of the present writing device eliminates completely the danger of the writers' cramp, considerably reduces fatigue while writing and renders the writing more rapid. This in turn makes the present device efficiently usable by pressmen, shorthand-typists, computer users, students, and school children. It has been noted also that children using the device master writing at an earlier age due to no necessity for grasping the pen, and develop even handwriting within a shorter period of time.

I claim:

1. A writing device having a support point adapted for supporting a finger, the device comprising:

a body with a longitudinal axis and having a writing element at one end thereof and an integrally formed elliptical ring at an opposite end thereof, the support point being located at said opposite end where said body and said elliptical ring meet;

said elliptical ring being formed within a plane and including a major axis disposed at an angle with respect to said longitudinal axis;

a projection-shaped counterweight connected to said elliptical ring and located on a side of said elliptical ring plane opposite said body; and wherein said counterweight is positioned and weighted so that a center of gravity of the device is located at the support point whereby the writing device is devoid of torque during use..

2. The writing device of claim 1, wherein an angle of the major axis of the elliptical ring with respect to the longitudinal axis is in a range of 28–35 degrees.

3. The writing device according to claim 1, wherein said body further comprises a recess disposed near said writing element adapted for receiving the finger of the user.

4. The writing device according to claim 1, wherein said body includes a loop disposed on said body near said writing element, said loop holding the finger of the user in place.

5. The writing device according to claim 4, wherein said elliptical ring and said body are comprised of materials having different elastic properties.

6. A writing device having a stem, an elliptical ring and a writing element, the elliptical ring having a major axis therethrough and disposed at the stem end opposite to the writing element, the writing device comprising:

a counterweight disposed on the side of the elliptical ring opposite the stem, said counterweight being shaped as a projection; and whereby the major axis of the elliptical ring is at an angle with the stem, said angle being in a range of 28–35 degrees.

* * * * *